US007697884B2

(12) United States Patent
Tateishi

(10) Patent No.: US 7,697,884 B2
(45) Date of Patent: Apr. 13, 2010

(54) IMAGE FORMING APPARATUS

(75) Inventor: Satohisa Tateishi, Abiko (JP)

(73) Assignee: Canon Kabushiki Kaisha (JP)

( * ) Notice: Subject to any disclaimer, the term of this patent is extended or adjusted under 35 U.S.C. 154(b) by 660 days.

(21) Appl. No.: 11/557,992

(22) Filed: Nov. 9, 2006

(65) Prior Publication Data

US 2007/0110490 A1 May 17, 2007

(30) Foreign Application Priority Data

Nov. 11, 2005 (JP) ..... 2005-328115

(51) Int. Cl.
*B65H 29/70* (2006.01)
*G03G 21/00* (2006.01)
*B65H 85/00* (2006.01)

(52) U.S. Cl. ..... 399/406; 399/401

(58) Field of Classification Search ..... 399/406
See application file for complete search history.

(56) References Cited

U.S. PATENT DOCUMENTS

2005/0063747 A1* 3/2005 Ushio ..... 399/406

FOREIGN PATENT DOCUMENTS

JP 07179258 A * 7/1995
JP 2004-26419 A 1/2004

* cited by examiner

*Primary Examiner*—Daniel J Colilla
(74) *Attorney, Agent, or Firm*—Rossi, Kimms & McDowell LLP

(57) ABSTRACT

The sheet conveying apparatus includes a first curl forming part provided downstream of a fixing part for fixing a toner image to a sheet, for curling the sheet; a second curl forming part provided downstream of the first curl forming part, for curling the sheet in a direction opposite to a direction in which the sheet is curled in the first curl forming part, in which a curling amount of the sheet in the second curl forming part is set to be smaller than that in the first curl forming part, and the curling amount of the sheet in the second curl forming part is variable according to rigidity of the sheet. Thus, a shape of the curled sheet can be reliably reformed with a simple structure.

5 Claims, 7 Drawing Sheets

IMAGE FORMING APPARATUS

BACKGROUND OF THE INVENTION

1. Field of the Invention

The present invention relates to an image forming apparatus, and more particularly, to a sheet conveying apparatus and an image forming apparatus with a structure for reforming a curl generated on a sheet.

2. Description of the Related Art

Up to now, in an image forming apparatus such as a copying machine and a printer for forming an image by an electrophotographic process, a toner image which has been formed in an image forming part is transferred onto a sheet fed from a sheet feeding part, and the toner image having been transferred onto the sheet is fixed to the sheet in a fixing part.

As an example of such the fixing part, there is a fixing part employing a heat-pressure fixing system for fixing a toner image to a sheet by applying heat and pressure to the sheet at the same time by a rotary member such as a pair of rollers. In a case of adopting the fixing part employing the heat-pressure fixing system, there arises a problem in that deformation (i.e., curl) is caused on a sheet when the toner image is fixed to the sheet.

In general, as the curl generated by the fixing part, there are three types of curls, that is, a heat curl, a toner curl, and a nip curl. As shapes of the curl, hereinafter, for understanding, an upward curl is defined as a shape in which leading and trailing edges of the sheet in a conveying direction of a sheet is higher than a central portion of the sheet, while a downward curl is defined as a shape in which leading and trailing edges of the sheet is lower than the central portion of the sheet.

Here, the heat curl is generated due to a difference between an amount of water contained in a front surface of the sheet and that contained in a back surface of the sheet. When heat is applied to the sheet in the fixing part, the heat curl is generated due to an expansion and contraction difference between both surfaces of the sheet which is caused by the difference between the amount of water contained in the front surface and that contained in the back surface of the sheet. There is a case where the heat curl is more likely to be generated because the sheet is prevented from absorbing moisture due to toner carried on the surface of the sheet.

The toner curl is generated during such a process that the toner transferred onto the sheet is melted by being applied with heat in the fixing part, and is then cooled and condensed.

The nip curl is generated due to physical deformation caused when the sheet is applied with heat and pressure in a nip part of a fixing roller in the fixing part for fixing toner to a sheet by application of heat and pressure with a pair of fixing rollers.

Here, sizes of the above-mentioned three-types of curls generated are different from each other depending on a plurality of causes such as a thickness or humidity (i.e., amount of humidity absorption) of a sheet, a toner amount transferred onto the sheet, and a temperature difference between nip rollers of the fixing part. For example, in the heat curl generated due to the difference between the amount of water contained in the front surface and that contained in the back surface of the sheet, a large difference in moisture absorption is easily generated between both surfaces of the sheet under such circumstances as thick paper or high humidity, thereby generating a large curl.

The toner curl generated due to the condensed toner transferred onto the sheet is affected by an amount of contraction at a time of toner contraction, a toner carrying amount, and a difference in an amount of toner carried on both surfaces of the sheet. In addition, when rigidity of the sheet is low, the sheet is more likely to be affected by the toner curl, so thin paper is more easily curled to a large extent than thick paper.

The nip curl generated depending on the shape of a nip part of the fixing roller tends to be the upward curl in which the leading and trailing edges of the sheet become higher than the central portion thereof, because, for example, the shape of the nip part becomes a convex shape in the downward direction when an upper roller is composed of a hard roller and a lower roller is composed of a soft roller.

Thus, there is the case where the sheet is curled due to various causes when the sheet passes through the fixing part. When the curled sheet is discharged without reforming the curl, there arises such problems that the sheet is curled up on a discharge tray, or subsequent sheets cannot be stacked on the tray due to blocking of an outlet by the trailing edge of the sheet, thereby deteriorating a stacking property of a sheet.

Thus, up to now, an image forming apparatus including a sheet conveying apparatus for conveying sheets having passed through the fixing part onto the discharge tray, which is provided with a curl reforming apparatus provided downstream of the fixing part and used for reforming a curl of a sheet has been put into practical use. The curl reforming apparatus is used for reforming a shape of a sheet by curling the sheet in a direction opposite to that of a curl of the sheet already generated by the fixing part. In the present application, a direction of a curl of the sheet before being reformed is defined as "pre-curled direction", and a direction of a curl of the sheet in which the sheet is curled to reform the curl of the sheet is defined as "curling direction", to thereby distinguish the directions of the curls. In addition, an amount of curl in the pre-curled direction is defined as "pre-curled amount", and an amount of curl in the curling direction in which the sheet is curled to reform the curl of the sheet is defined as "curling amount".

As a system of the curl reforming apparatus, there are a system capable of controlling the curling amount of the sheet by using an actuator, and a system in which the curling amount is not controlled by setting the curling amount to be constant.

Here, in a case of the curl reforming apparatus which does not control the curling amount, the pre-curled direction is not fixed to one direction due to the thickness of the sheet or the toner carrying amount as described above, so there is a case where the pre-curled direction matches the curling direction by the curl reforming apparatus, which results in further curling of the sheet. In such the case, there has been a problem of, for example, curling of the sheet on the discharge tray.

Accordingly, as the curl reforming apparatus for sufficiently reforming a curl of a sheet, there has been proposed a curl reforming apparatus in which a curl forming part for curling a sheet in an upward direction is provided along with another curl forming part for curling a sheet in a downward direction, and one of the curl forming parts is selectively used based on detection by curl detecting means for detecting a curl of a sheet.

Further, as an example of the curl reforming apparatus with such the structure, there is one disclosed in Japanese Patent Application Laid-open No. 2004-026419 in which the pre-curled direction and the pre-curled amount of the sheet are detected by the curl detecting means, and the curling amount of the curl forming part selected based on the detected pre-curled direction and the pre-curled amount is adjusted, to thereby appropriately reform the curl of the sheet.

FIG. 5 is an explanatory view of a sheet conveying apparatus including such the conventional curl reforming apparatus. In FIG. 5, reference symbol FX denotes a fixing part, and reference numeral 104 denotes a curl reforming apparatus for reforming a curl of a sheet P. The fixing part FX includes an entering guide FX1, a heat roller FX 2 provided on an inner side of a fixing heat source FX4, a pressure roller FX3, and discharge rollers FX5. An outer peripheral surface of the heat roller FX2 is set such that the outer peripheral surface has a wider rubber layer as compared with the pressure roller FX3, and the rubber layer of the heat roller FX2 is deformed to a large extent in the nip part between the heat roller FX2 and the pressure roller FX3 with the nip part having a convex shape in the upward direction.

The curl reforming apparatus 104 includes three rollers 104*a* to 104*c* serving as curl reforming members, and a support disk 104*d* rotationally supporting the rollers 104*a* to 104*c*. A fixed guide 100 is a fixed guide composed of a pair of guide plates 100*a* and 100*b*, movable guides 101 and 102 are composed of a pair of guide plates 101*a* and 101*b* and a pair of guide plates 102*a* and 102*b*, respectively, and a fixed guide 103 is composed of a pair of guide plates 103*a* and 103*b*.

The guide plates 101*a* and 101*b* of the movable guide 101 and the guide plates 102*a* and 102*b* of the movable guide 102 are lightweight members and are each composed of, for example, a plastic sheet or a plurality of rods. As shown in FIG. 6B, the guide plates 101*a* and 101*b* of the movable guide 101 and the guide plates 102*a* and 102*b* of the movable guide 102 are loosely connected at a connected portion Y. In addition, downstream end portions of the movable guides 101 and 102, that is, end portions of the guide plates 101*a* and 102*a* on a side closer to the fixed guide 103 are free ends so as to move within the fixed guide 103.

In the curl reforming apparatus with such the structure, the nip part between the heat roller FX2 and the pressure roller FX3 is heated, an unfixed toner image is subjected to a fixing process, and then the sheet P passes through the fixed guide 100, the movable guides 101 and 102, and the fixed guide 103.

In this case, as shown in FIG. 6A, there is a sheet P having the downward curl, in which a central portion of the sheet becomes higher than the leading and trailing edges thereof on a side bearing the fixed toner image, depending on the thickness or humidity of the sheet, the transferred toner amount, the temperature difference between the nip rollers of the fixing part, and the like. In addition, as shown in FIG. 7, there is a sheet P having the upward curl in which a central portion of the sheet becomes lower than the leading and trailing edges thereof on a side bearing the fixed toner image.

Further, for example when the sheet P before image formation is curled, a state of the curl is varied such as the curl of the sheet remains after the image formation, or the curl is reformed, and a generating level of the curl is different in each case. In addition, in the curl generated due to the fixing process, the upward curl or the downward curl may be generated depending on a paper quality, the amount of humidity absorption, and the like of the sheet P, and the generating level of the curl is also varied.

When the sheet P passes through the movable guides 101 and 102, for example, when the curl of the sheet P is the downward curl, the movable guides 101 and 102 are deformed as shown in FIG. 6A. In FIG. 6B, a variable resistor 105 constitutes the curl detecting means together with the movable guides 101 and 102.

The variable resistor 105 includes a slider 105*b* which moves integrally in a vertical direction with the connected portion Y, and a resistor 105*a* serving as displacement detecting means for detecting a position of the slider 105*b*. The variable resistor 105*a* detects the position of the slider 105*b* according to a resistivity of the resistor 105*a*.

In the variable resistor 105, when the sheet P enters the movable guides 101 and 102, the movable guide 101 moves in the upward direction with a base 101X as an axis along with the curl of the sheet P. Then, a movement of the movable guide 101 is converted into voltage by the variable resistor 105 serving as the displacement detecting means, and the direction (i.e., downward curl) and the level of the curl of the sheet P are detected based on a voltage value.

Further, the curl reforming apparatus 104 reforms the upward curl in a state shown in FIG. 6A, and reforms the downward curl in a state shown in FIG. 7 in which the support disk 104*d* is rotated by 30°. In this case, the support disk 104*d* is rotated by a control of controlling means 106, and the controlling means 106 controls a rotational angle of the support disk 104*d* based on an output of the variable resistor 105.

Accordingly, with respect to the sheet P curled in the downward direction, the curl reforming apparatus 104 becomes a state shown in FIG. 6A, thereby reforming the curl of the sheet P during a conveying process of the sheet P, and with respect to the sheet P curled in the upward direction, the curl reforming apparatus 104 becomes a state shown in FIG. 7, thereby reforming the curl of the sheet P such that the curl thereof is eliminated.

However, in the conventional sheet conveying apparatus, in order to achieve the curl detecting means and the controllable curl reforming means, there has been a problem in that a size of the apparatus is increased and the number of components is increased, which increases the size of the entire image forming apparatus and costs required for the apparatus.

SUMMARY OF THE INVENTION

Therefore, the present invention has been made in view of the above-mentioned circumstances, and a purpose of the present invention is to provide and an image forming apparatus capable of reliably reforming a curled shape of a sheet with a simple structure.

Another purpose of the present invention is to provide an image forming apparatus including a first curl forming part provided downstream of a fixing part for fixing a toner image to a sheet, configure to curl the sheet; and a second curl forming part provided downstream of the first curl forming part, configure to curl the sheet in a direction opposite to a direction in which the sheet is curled in the first curl forming part, wherein a curling amount of the sheet in the second curl forming part is set to be smaller than that in the first curl forming part, and the curling amount of the sheet in the second curl forming part is variable according to rigidity of the sheet.

Further features of the present invention will become apparent from the following description of exemplary embodiments with reference to the attached drawings.

DESCRIPTION OF THE EMBODIMENTS

Hereinafter, preferred embodiments of the present invention will be described in detail with reference to the attached drawings.

Figure 3:
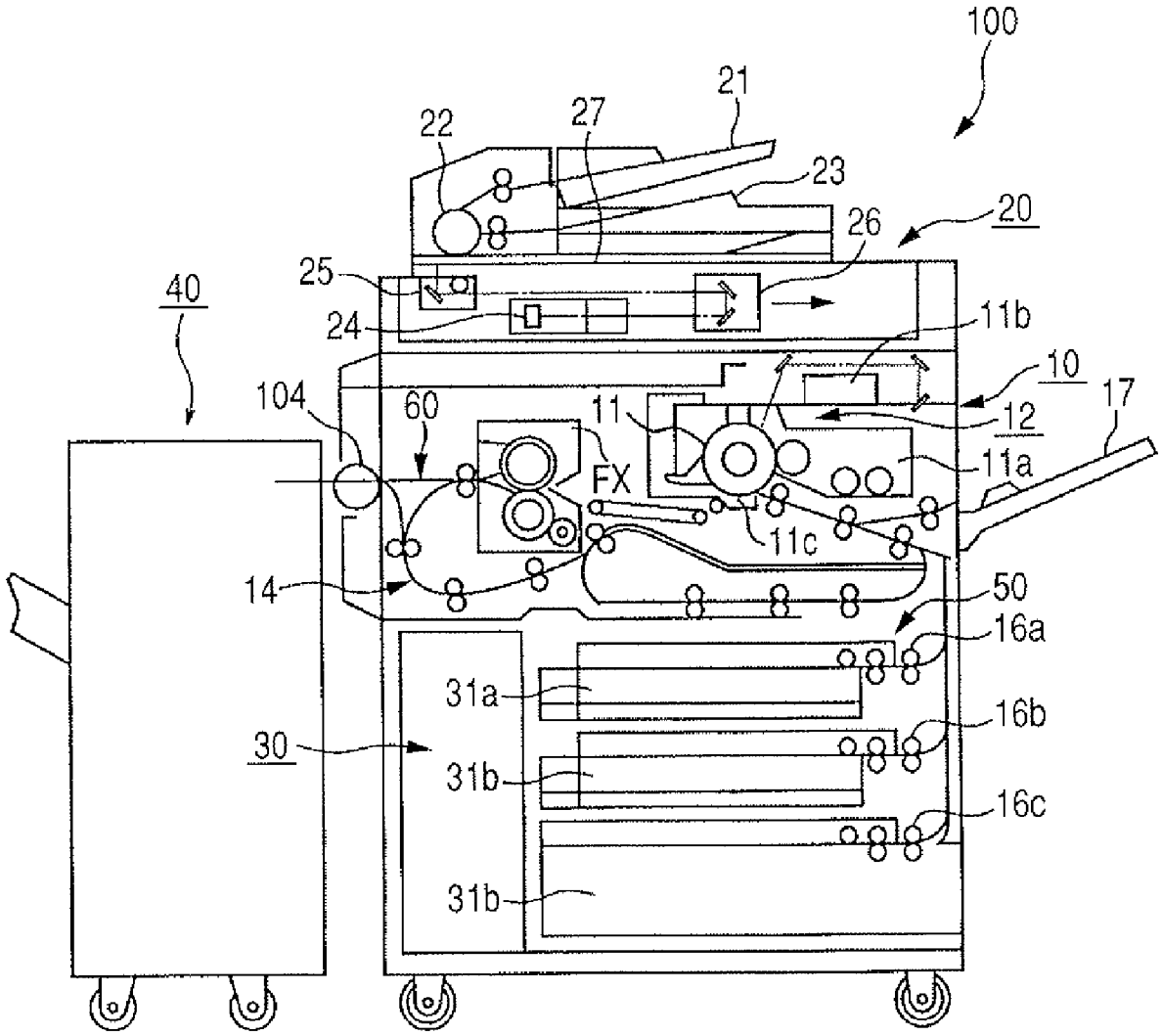
FIG. 3 is a schematic structural view of the image forming apparatus according to the first embodiment of the present invention.

FIG. 3 is a schematic structural view of an image forming apparatus 100 according to a first embodiment of the present invention. The image forming apparatus 100 includes an image forming main body 10 (hereinafter, referred to as "main body") and an image reading part 20 arranged on an upper part of the main body 10.

The image reading part 20 includes an original feed table 21 on which an original is loaded, a platen roller 22 for conveying the original and positioning a reading position, an original discharge table 23 on which the read original is loaded, and an image sensor 24 for receiving image light to convert the image light into a image signal. In addition, the image recording part 20 includes a first scanning unit 25 and a second scanning unit 26. The first scanning unit 25 is composed of a lamp for illuminating the original and a mirror, and is movable so as to scan the original loaded on an original stacking table 27. The second scanning unit 26 is composed of two mirrors and is movable at a half speed of the first scanning unit 25.

The image reading part 20 has an original reading function of conveying the original from the original feed table 21 to read the original, and another original reading function of scanning a stationary original loaded on the original stacking table 27 to read the original. In other words, the image reading part 20 generates image data by reading images formed on the original loaded on the original stacking table 27.

Further, below the image reading part 20, there are provided an image forming part 12 for forming an image on a sheet by an electrophotographic process, and a sheet feeding part 50 for feeding the sheet to the image forming part 12. In addition, on a side of the main body 10, there is provided a treating apparatus 40 for performing processes such as a stitch process, a shift process, a folding process, and a punching process with respect to the sheet having an image formed thereon which is discharged from the main body 10. Here, the image forming part 12 includes a photosensitive drum 11, a developing device 11*a*, and a laser scanner unit 11*b*.

Further, the sheet feeding part 50 includes a sheet containing part 30 which is provided with a plurality of cassettes 31 (31*a*, 31*b*, and 31*c*) detachably mounted on the main body 10 and contains sheets P, and sheet feeding means 16 (16*a*, 16*b*, and 16*c*) for feeding sheets contained in the cassettes 31. Reference numeral 17 denotes a manual feeding part. The sheets are supplied from the sheet feeding part 50 and the manual feeding part 17 to the image forming part 12.

Next, an operation of the image forming apparatus 100 will be described.

When an image reading signal is outputted from a control device (not shown), which is provided to the main body 10, to the image reading part 20, the original is loaded on the original stacking table 27. After that, the original loaded on the original stacking table 27 is applied with light from a light source of the first scanning unit 25, and the light is reflected. Then, the light reflected from the original is inputted to the image sensor 24 through the first scanning unit 25 and the second scanning unit 26, and is converted into an electronic signal. After that, a laser beam corresponding to the electronic signal is irradiated on the photosensitive drum 11 from the laser scanner unit 11*b*.

In this case, the photosensitive drum 11 is charged in advance, and an electro-static latent image is formed on the photosensitive drum 11 by irradiation of light, and then the electro-static latent image is developed by the developing device 11*b*, thereby forming a toner image on the photosensitive drum 11.

On the other hand, when a sheet feeding signal is outputted to the sheet feeding part 50 from the control device, the sheet P is supplied from the cassettes 31 or the manual feeding part 17. After that, the fed sheet P is conveyed to a transferring part, which is composed of the photosensitive drum 11 and a transfer charging device 11*c*, at a predetermined timing.

Next, the toner image is transferred onto the sheet thus conveyed to the transferring part, and is then conveyed to a fixing part FX serving as a fixing part. Further, the toner image is applied with heat and pressure by the fixing part FX, thereby permanently fixing an unfixed transfer image to the sheet P. The sheet P on which the image is thus fixed is discharged from the main body 10 by a discharge roller 104, and is conveyed to the treating apparatus 40.

The image forming apparatus 100 has a two-side image forming function and a reverse discharge function. In a two-side printing mode of forming images on both surfaces of the sheet, the image is fixed to a first surface of the sheet P by the fixing part FX, and then the sheet P is conveyed again to the image forming part 12 through a reverse conveyance part 14.

Further, in a reverse discharge mode of reversing the sheet P and discharging the sheet P to an outside of the main body, the sheet P subjected to the fixing process is conveyed to the reverse conveyance part 14, and is then discharged to the treating apparatus 40 by reversing the surface of the sheet P.

Figure 1:
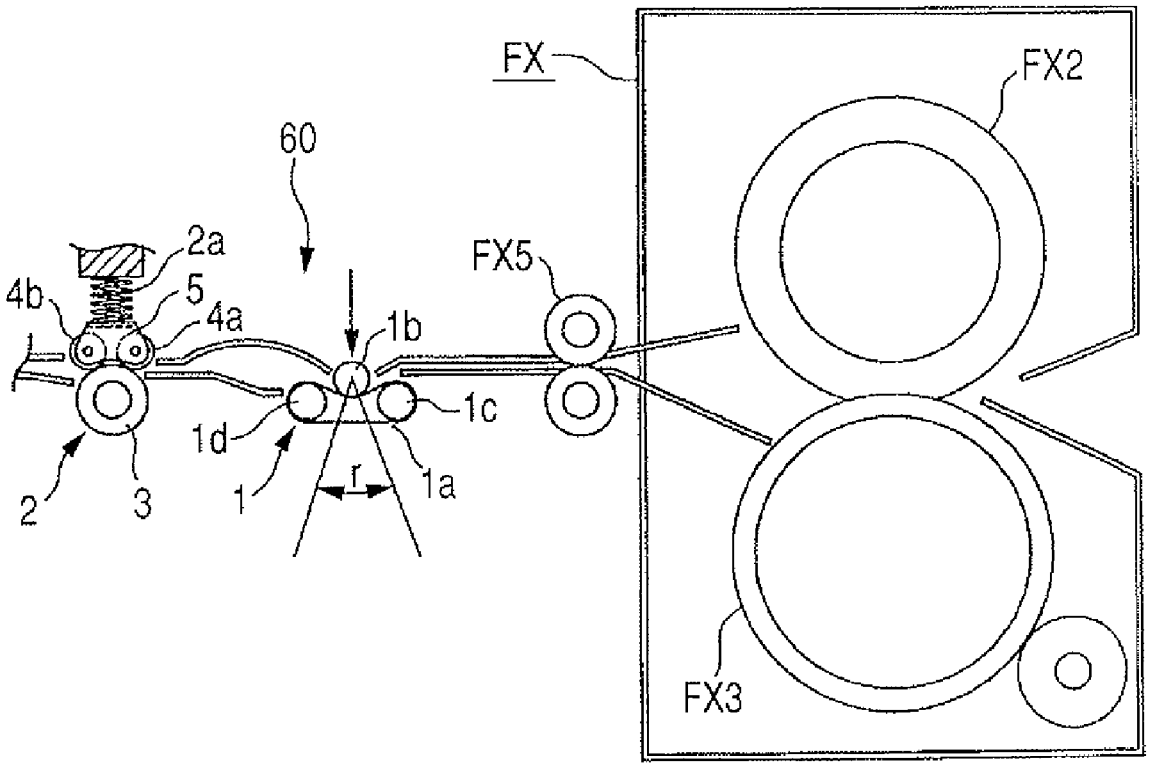
FIG. 1 is an explanatory view of a sheet conveying apparatus provided to an image forming apparatus according to a first embodiment of the present invention.

At a downstream of the fixing part FX, as shown in FIG. 1, there is provided a sheet conveying apparatus 60 including discharge rollers FX5 for conveying the sheet P having the image fixed thereto to the treating apparatus 40. The sheet conveying apparatus 60 is provided with a curl reforming apparatus. The curl reforming apparatus reforms the curl of the sheet by curling the sheet P in a direction opposite to that of the curl already generated in the sheet P. The curl reforming apparatus includes a belt-type curl reforming apparatus 1 serving as a first curl forming part for curling the sheet P in an upward direction having the image fixed thereto, and a roller-type curl reforming apparatus 2 serving as a second curl forming part for curling the sheet P in a downward direction. As described above, in the present invention, as the shapes of the curl, one in which the leading and trailing edges of the sheet become higher than the central portion thereof in the conveying direction of the sheet is defined as the upward curl, and one in which the leading and trailing edges thereof become lower than the central portion thereof is defined as the downward curl.

Here, the belt-type curl reforming apparatus 1 includes a belt 1*a* wound around two rollers 1*c* and 1*d*, and a conveyance shaft 1*b* which is pressed against the belt 1*a* by an urging spring (not shown) in a direction indicated by the arrow and rotates in the conveying direction of the sheet in a state where the belt 1*a* is bent. Then, the conveyance shaft 1*b* is thus pressed against the belt 1*a* in the state where the belt 1*a* is bent, thereby conveying the sheet P by the conveyance shaft 1*b* while being curled in an upward direction when the sheet P passes through the belt-type curl reforming apparatus 1.

The roller-type curl reforming apparatus 2 includes a drive roller 3 which is a larger diameter roller, and winding rollers 4*a* and 4*b* which are a plurality of (two in this embodiment) smaller diameter rollers is on the drive roller 3 with pressure. The winding rollers 4*a* and 4*b* are rotationally held by a roller holder 5. The urging spring 2*a* urges a substantially central portion of the roller holder 5 to be on or off the drive roller 3, and swingably presses the roller holder 5.

Thus, two winding rollers 4*a* and 4*b* are on the drive roller 3 with the pressure, and the sheet P is pressed against the drive roller 3 by the winding rollers 4*a* and 4*b*, thereby curling the sheet P in a downward direction along a peripheral surface of the drive roller 3 when the sheet P passes through the roller-type curl reforming apparatus 2.

In the first embodiment, the curling direction of the belt-type curl reforming apparatus 1 is set to be opposite to that of the roller-type curl reforming apparatus 2, and the curling amount of the roller-type curl reforming apparatus 2 is set to be smaller than that of the belt-type curl reforming apparatus 1. In addition, as described later, the roller-type curl reforming apparatus 2 is structured such that the curling amount is automatically varied according to the rigidity of the sheet with a curl to be reformed.

An outer peripheral surface of a heat roller FX2 is set such that the outer peripheral surface has a wider rubber layer as compared with a pressure roller FX3, and the rubber layer of the heat roller FX2 is deformed to a large extent in the nip part between the heat roller FX2 and the pressure roller FX3 with the nip part having a convex shape in the upward direction. As a result, the sheet P discharged from the fixing part FX is conveyed to the belt-type curl reforming apparatus 1 through the discharge rollers FX5 provided downward of the fixing part in a state where the sheet P is curled in a downward direction.

In this case, since the nip part of the fixing part FX has the convex shape, the belt-type curl reforming apparatus 1 is structured such that the sheet is curled in an upward direction and the curling amount is set to have a force sufficient for reforming the downward curl of the sheet P having high rigidity such as thick paper. As a result, even when the sheet P is thick paper or the like, the sheet P is curled in an upward direction, and then the sheet P thus curled in an upward direction by the belt-type curl reforming apparatus 1 is conveyed to the roller-type curl reforming apparatus 2.

Figure 2A:
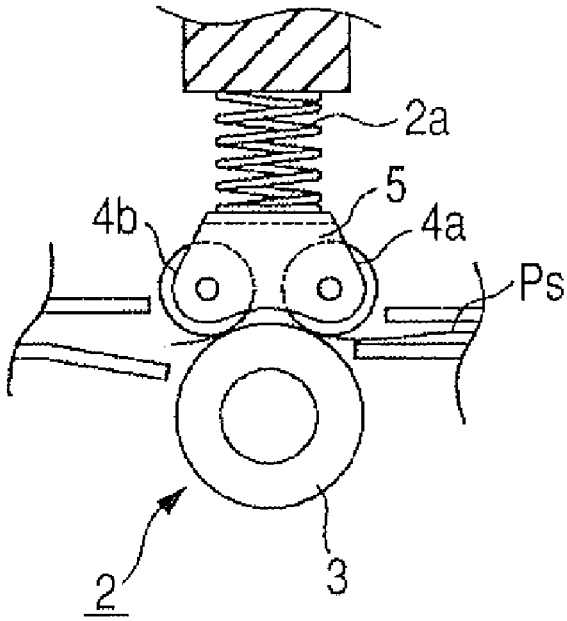
FIGS. 2A and 2B are explanatory views of a curling operation of a roller-type curl reforming apparatus provided to the sheet conveying apparatus.

In the roller-type curl reforming apparatus 2, an urging force by the urging spring 2*a* is set to be larger than a reaction force of the sheet P having low rigidity and to be smaller than a reaction force of the sheet P having high rigidity. Thus, in a case of using a sheet P having low rigidity as the sheet P, a sheet Ps is conveyed while being pressed against the drive roller 3 by the winding rollers 4*a* and 4*b* as shown in FIG. 2A. As a result, the sheet Ps is curled in a downward direction along with the peripheral surface of the drive roller 3.

Figure 2B:
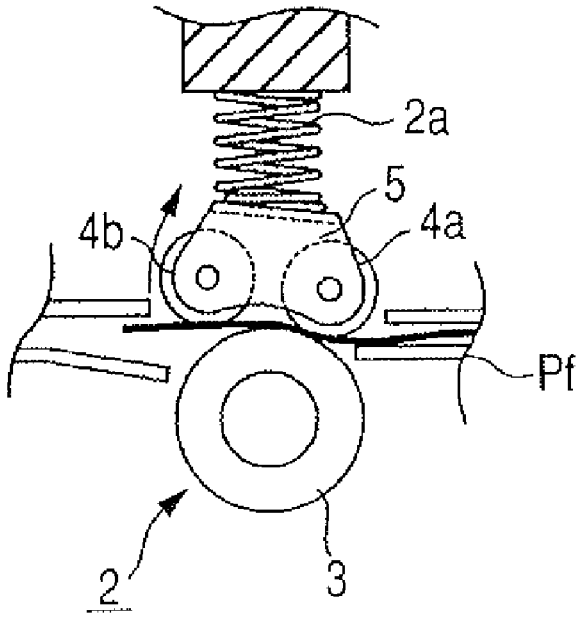

On the other hand, in a case where a thick sheet Pf having high rigidity is used as the sheet P, the reaction force by the sheet Pf is larger than the urging force by the urging spring 2*a*, so the sheet Pf is spaced apart from the drive roller 3 with the winding roller 4*b*, which is provided on the downstream side of the urging spring, against an elastic force of the urging spring 2*a*, as shown in FIG. 2B. As a result, the sheet Pf is conveyed while not being pressed against the drive roller 3, so the curling amount of the sheet curled in a downward direction becomes small.

In this case, a thin sheet Ps has low rigidity, so the thin sheet Ps is easily curled in a downward direction by the nip having a convex shape of the fixing part FX. However, at the downstream of the fixing part FX, there are arranged the belt-type curl reforming apparatus 1 capable of curling the sheet in an upward direction to a large extent, and the roller-type curl reforming apparatus 2 capable of curling the sheet in a downward direction to a small extent as compared with the belt-type curl reforming apparatus 1. Thus, when the sheet P curled in a downward direction by the fixing part FX passes through the belt-type curl reforming apparatus 1, the sheet P is temporarily curled in an upward direction. However, thereafter, when the sheet P passes through the roller-type curl reforming apparatus 2, the upward curl of the sheet P is suppressed, thereby making it possible to improve a stacking property of the sheet onto the discharge tray. While the heat curl generated by the fixing part FX is not largely generated in the thin sheet Ps, the thin sheet Ps is more likely to be affected by the toner curl when a large amount of toner is carried on the sheet. Accordingly, the sheet may be curled in an upward direction depending on the amount of toner carried on the sheet.

Then, in the case where the sheet is thus curled in an upward direction, when the belt-type curl reforming apparatus 1 capable of providing the sheet with a large upward curling amount is arranged at the downstream of the fixing part FX, the upward curl of the sheet generated by the belt-type curl reforming apparatus 1 is superimposed on the upward curl of the sheet due to the toner curl, thereby curling the sheet in an upward direction to a large extent. However, even when the sheet is thus curled in an upward direction to a large extent, the roller-type curl reforming apparatus 2 is arranged at the downstream of the belt-type curl reforming apparatus 1, thereby making it possible to suppress the upward curl of the thin sheet Ps having low rigidity and improve the stacking property of the sheet onto the discharge tray.

On the other hand, while the heat curl generated by the fixing part FX is largely generated in the thick sheet Pf because the thick sheet Pf has high rigidity, the thick sheet Pf is less likely to be affected by the toner curl because the rigidity thereof is high even when a large amount of toner is carried on the sheet. Thus, the thick sheet Pf is likely to generate the downward curl in a direction of the heat curl.

Accordingly, the belt-type curl reforming apparatus 1 capable of curling the sheet in an upward direction to a large extent is arranged at the downstream of the fixing part FX in which the downward curl tends to be generated, thereby making it possible to sufficiently reform the downward curl due to the heat curl. As shown in the above-mentioned FIG. 2B, when the thick sheet Pf is conveyed, the winding roller 4*b* provided on the downstream side of FIG. 2 is automatically spaced apart from the drive roller 3 due to the rigidity of the sheet, so the roller-type curl reforming apparatus 2 hardly curls the thick sheet Pf in a downward direction. As a result, it is possible to suppress the downward curl of the thick sheet Pf having high rigidity and improve the stacking property of the sheet onto the discharge tray.

In the first embodiment, with regard to the belt-type curl reforming apparatus 1, a diameter of the conveyance shaft 1*b*, a winding angle of the belt 1*a* with respect to the conveyance shaft 1*b*, and the like are set as follows so as to generate a force sufficient for reforming the downward curl of the sheet having high rigidity such as thick paper. That is, the diameter of the conveyance shaft 1*b* is set to Φ10 mm or smaller, the winding angle r of the belt 1*a* with respect to the conveyance shaft 1*b* shown in FIG. 1 is set to 45° or larger, and an applied pressure P of the conveyance shaft 1*b* in the direction of the belt 1*a* is set to 4N or larger in total.

In addition, with regard to the roller-type curl reforming apparatus 2, a diameter of the drive roller 3 is set to Φ12 mm or larger, a winding angle (i.e., angle formed between lines each connecting each nip part of the rollers and a rotation center of the drive roller 3) of the sheet P with respect to the drive roller 3 by the winding rollers 4*a* and 4*b* is set to 55° or smaller, and a pressing force of the urging spring 5 is set to 10N or smaller in total.

Thus, the belt-type curl reforming apparatus 1 is arranged at the downstream of the fixing part FX, and the roller-type curl reforming apparatus 2 for curling the sheet in a direction opposite to that of the curl of the sheet generated by the belt-type curl reforming apparatus 1 is arranged at the downstream of the belt-type curl reforming apparatus 1. The curling amount of the roller-type curl reforming apparatus 2 is set to be smaller than that of the belt-type curl reforming apparatus 1, and the curling amount of the roller-type curl reforming apparatus 2 is variable according to the rigidity of the sheet, thereby making it possible to reliably reform the curl of the sheet with a simple structure. As a result, it is possible to provide the sheet conveying apparatus 60 which has a low-cost curl reforming function with a smaller size and a small number of parts, and which achieves the preferable stacking property of the sheet onto the discharge tray.

In the above description, the belt-type curl reforming apparatus 1 is adopted as the first curl forming part, and the roller-type curl reforming apparatus 2 is adopted as the second curl forming part. However, as long as the curling amount of the sheet curled by the first curl forming part is set to be larger than the curling amount of the sheet curled by the second curl forming part, any apparatus of various curling systems may be adopted.

In the first embodiment, the fixing part FX tends to generate the downward curl, so the belt-type curl reforming apparatus 1 curls the sheet in an upward direction, and the roller-type curl reforming apparatus 2 curls the sheet in a downward direction. However, when the fixing part FX is set, that is, when the nip part has a concave shape, the belt-type curl reforming apparatus 1 curls the sheet in a downward direction, and the roller-type curl reforming apparatus 2 curls the sheet in an upward direction.

Further, for example, an operation part (not shown) is provided as inputting means for inputting information on the rigidity of the sheet so as to vary the curling amount by the belt-type curl reforming apparatus 1 based on the information on the rigidity of the sheet from the operation part, thereby making it possible to widen a range of the reformation of the curl.

Next, a second embodiment of the present invention will be described.

Figure 4:
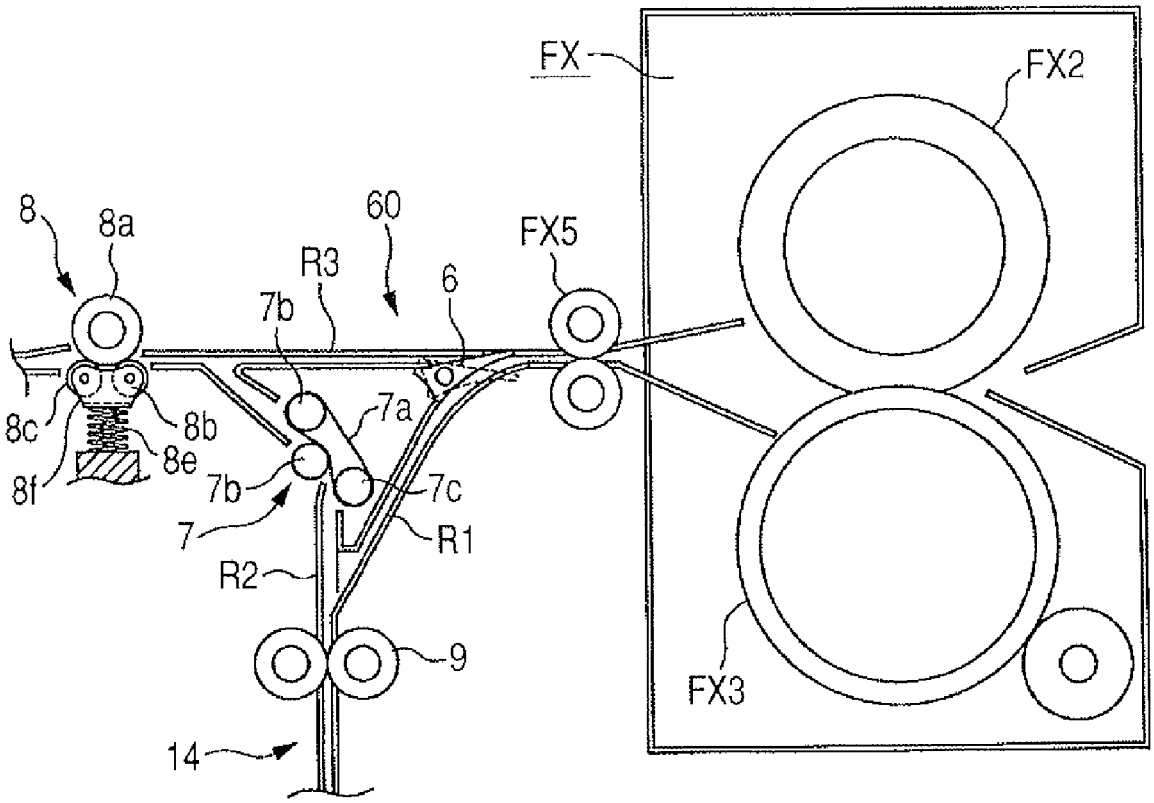
FIG. 4 is a structural view of a sheet conveying apparatus provided to an image forming apparatus according to a second embodiment of the present invention.
Figure 5:
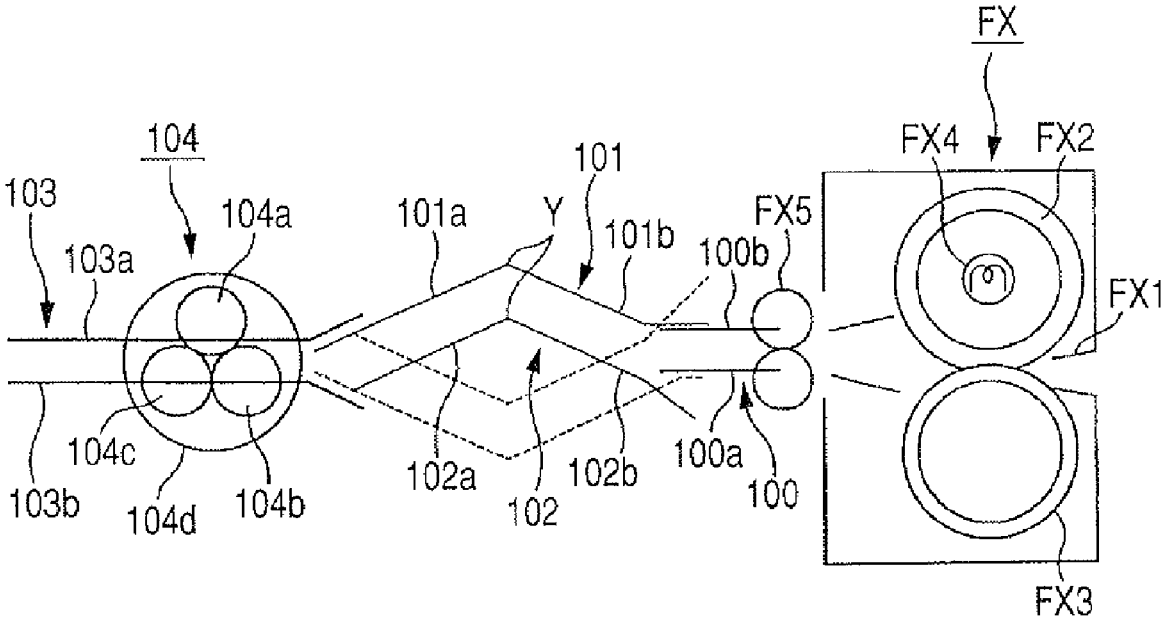
FIG. 5 (Prior Art)
FIG. 5 is an explanatory view of a sheet conveying apparatus including a conventional curl reforming apparatus.
Figure 6A:
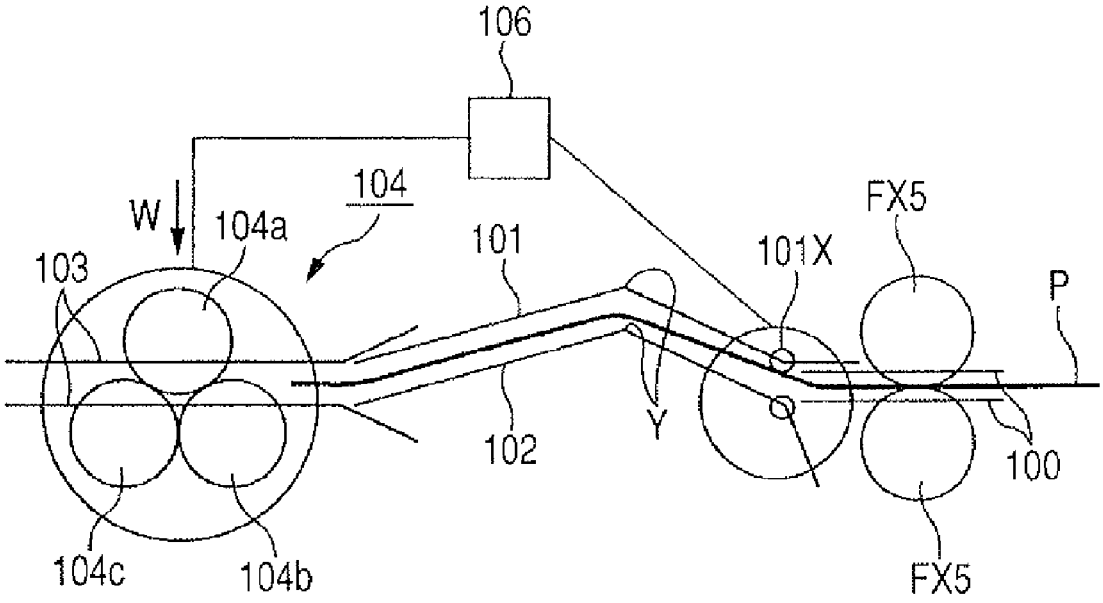
FIG. 6A (Prior Art)
FIGS. 6A and 6B are explanatory views of an operation of the conventional curl reforming apparatus.
Figure 6B:
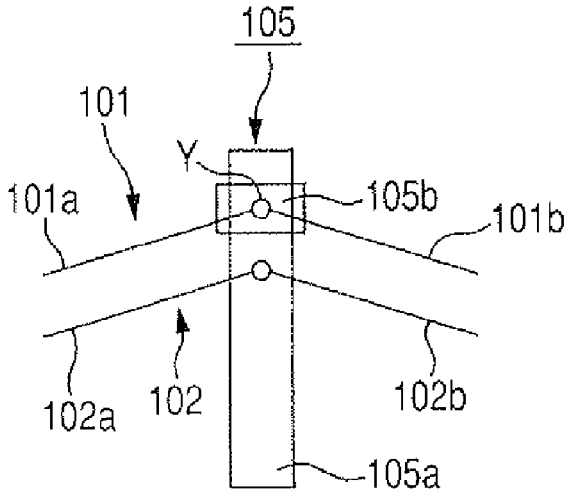
FIG. 6B (Prior Art)
Figure 7:
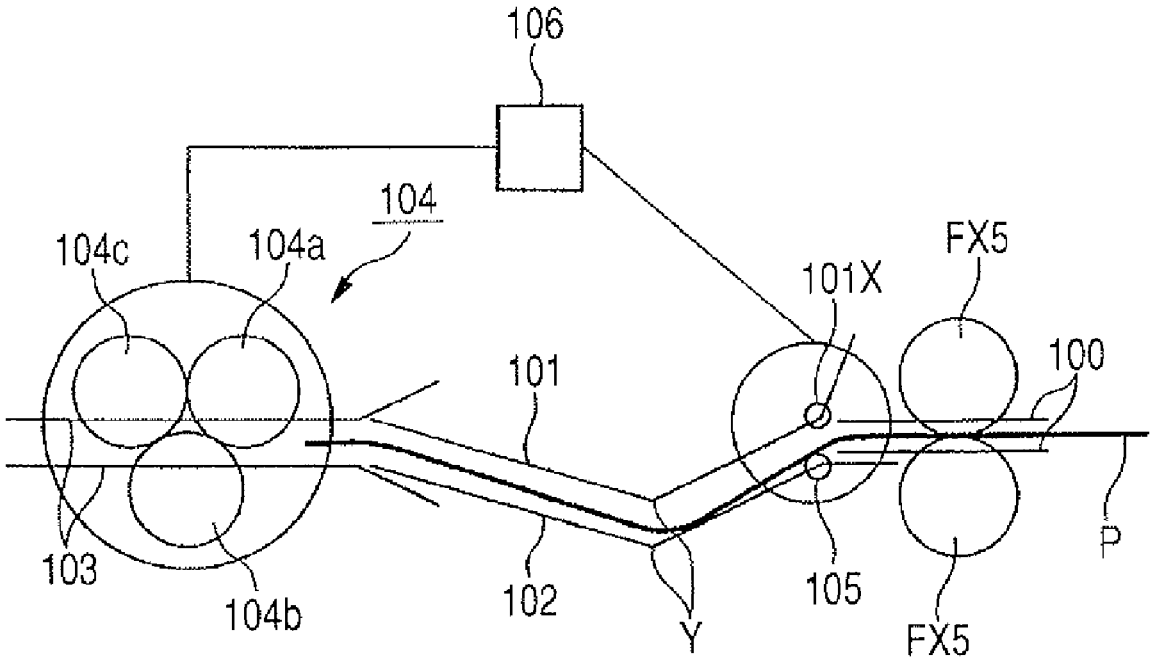
FIG. 7 (Prior Art)
FIG. 7 is an explanatory view of the operation of the conventional curl reforming apparatus.

FIG. 4 is a structural view of a sheet conveying apparatus provided to an image forming apparatus according to the second embodiment. In FIG. 4, the same reference symbols shown in FIG. 1 denote the identical parts or corresponding parts.

Reference symbol R3 denotes a straight sheet-discharge path serving as a first conveyance path through which the sheet having passed through the fixing part FX passes. Reference symbol R1 denotes a guide path serving as a second conveyance path which branches from the straight sheet-discharge path R3 and guides the sheet to the reverse conveyance part 14 (see FIG. 4) when the two-side printing mode in which images are formed on both surfaces of the sheet, and the reverse discharge mode are set. Reference symbol R2 denotes a sheet surface reverse path serving as a third conveyance path for conveying the sheet reversed after the sheet passes through the guide path R1 to the straight sheet-discharge path R3.

In order to select the sheet conveyance path after the sheet has passed through the fixing part FX, a flapper 6 is arranged on the sheet conveyance path. When the flapper 6 is arranged at a position indicated by the solid line, the sheet is guided to the guide path R1, and when the flapper 6 is arranged at a position indicated by the broken line, the sheet is guided to the straight sheet-discharge path R3. A conveyance roller 9 capable of rotating in a forward or backward direction is provided to the reverse conveyance part 14. The conveyance roller 9 reverses the surface of the sheet P and discharges the sheet P by rotating in the forward or backward direction during the reverse discharge of the sheet, and guides the sheet P to the reverse conveyance part 14 by rotating in the forward direction during the two-side printing operation.

A belt-type curl reforming apparatus 7 is provided on the sheet surface reverse path. The belt-type curl reforming apparatus 7 is the first curl forming part for curling the sheet in the downward direction. The belt-type curl reforming apparatus 7 includes a belt 7*a* wound around two rollers 7*c* and 7*d*, and a conveyance shaft 7*b* which is pressed against the belt 7*a* by an urging spring (not shown) and rotates in the sheet conveying direction in a state where the belt 7*a* is bent. Thus, the conveyance shaft 7*b* is pressed against the belt 7*a* in the state where the belt 7*a* is bent, thereby curling the sheet in the downward direction when the sheet passes through the belt-type curl reforming apparatus 7.

A roller-type curl reforming apparatus 8 is provided on the downstream side of a confluent part of the sheet surface reverse path R2 and the straight sheet-discharge path R3. The roller-type curl reforming apparatus 8 is the second curl forming part for curling the sheet in the upward direction. The roller-type curl reforming apparatus 8 includes a drive roller 8*a* which is a larger diameter roller, and winding rollers 8*b* and 8*c* which are a plurality of (two in this embodiment) smaller diameter rollers urged by an urging spring 8*e* and on or off the drive roller 8*a*.

The winding rollers 8*b* and 8*c* are rotatably held by a roller holder 8*f*. The urging spring 8*e* urges a substantially central portion of the roller holder 8*f* so that the winding rollers 8*b* and 8*c* are on or off the drive roller 8*a*.

In this case, with regard to the roller-type curl reforming apparatus 8, similarly to the above-mentioned roller-type curl reforming apparatus 2 according to the first embodiment, the urging force by the urging spring 8*e* is set to be larger than the reaction force of the sheet P having low rigidity and to be smaller than the reaction force of the sheet P having high rigidity. In other words, the roller-type curl reforming apparatus 8 is structured such that the curling amount is automatically varied according to the rigidity of the sheet with a curl to be reformed.

However, according to the second embodiment, two winding rollers 8*b* and 8*c* are on the drive roller 8*a* with pressure in the downward direction against the drive roller 8*a*. Thus, when the sheet passes through the roller-type curl reforming apparatus 8, the sheet is curled in the upward direction by the roller-type curl reforming apparatus 8.

Next, a curl reforming operation according to the second embodiment will be described.

When the two-side printing mode is set, after printing on the first surface is completed, the flapper 6 is moved in the upward direction as indicated by the solid line to guide the sheet P to the guide path R1. After that, the sheet P is conveyed to the image forming part again through the reverse conveyance part 14 to perform printing on the back surface of the sheet P, and then the sheet P passes through the fixing part FX again. In this case, the flapper 6 moves in the downward direction as indicated by the broken line, and guides the sheet P, which has been curled in the downward direction by the fixing part FX, in the direction of the roller-type curl reforming apparatus provided on the downstream side of FIG. 4.

Thus, the sheet is curled in the upward direction by the roller-type curl reforming apparatus 8.

During the two-side printing operation, the sheet to be discharged passes through the fixing part FX twice to perform the two-side printing operation. In the case where the sheet passes through the fixing part FX twice within a short period of time as in the two-side printing, most of the water contained in the sheet is lost when the sheet passes through the fixing part FX for the first time, and when the sheet passes through the fixing part FX for the second time, a difference between an amount of water contained in the front surface and that contained in the back surface of the sheet becomes smaller.

The heat curl largely depends on the difference in water amount between both surfaces of the sheet as described above, so in a case of using a particularly thick sheet, the downward curl due to the heat curl of the sheet generated during the two-side printing operation becomes small in terms of degree. According to the second embodiment, a small downward curl of the sheet is reformed by the roller-type curl reforming apparatus 8.

Further, when the reverse discharge mode is set, the flapper 6 is moved in the upward direction as indicated by the solid line to guide the sheet P to the guide path R1. After that, the sheet P is reversed by a switch-back operation by the conveyance roller 9, and then passes through the belt-type curl reforming apparatus 7 to curl the sheet in the downward direction. Then, the sheet is curled in the upward direction by the roller-type curl reforming apparatus 8 provided on the downstream side of FIG. 4.

In this case, during the sheet reversing operation, the surface of the sheet passing through the fixing part FX and curled in the downward direction is reversed by the sheet surface reverse path R2. As a result, the direction of the curl is also reversed, that is, the curl becomes the upward curl, so the sheet curled in the upward direction is curled in the downward direction by the belt-type curl reforming apparatus 7. After that, the sheet is curled in the upward direction by the roller-type curl reforming apparatus 8.

In the second embodiment, the roller-type curl reforming apparatus 8 is provided on the downstream side of the confluent part of the sheet surface reverse path R2 and the straight sheet-discharge path R3, and functions as the second curl forming part described above in the first embodiment during the sheet reversing operation. In addition, the roller-type curl reforming apparatus 8 is structured to function as the curl forming part for reforming the small downward curl during the two-side printing operation.

As a result, it is possible to ensure the preferable stacking property of the sheet during the reversing operation and the two-side printing operation. In addition, it is possible to provide the sheet conveying apparatus in which the preferable stacking property of the sheet can be ensured during the two-side printing/reversing operation, and a reduction in size and cost of the apparatus is achieved with the simple structure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-328115, filed Nov. 11, 2005, which is hereby incorporated by reference herein in its entirety.

What is claimed is:

1. An image forming apparatus, comprising:

a first conveyance path through which a sheet having passed through a fixing part passes, the fixing part for fixing a toner image to the sheet;

a second conveyance path branched from said first conveyance path;

a third conveyance path through which a sheet having passed through said second conveyance path passes to the first conveyance path in a condition where a surface of the sheet is reversed;

a first curl forming part configured to curl the sheet, said first curl forming part being provided in said third conveyance path; and a second curl forming part configured to curl the sheet in a direction opposite to a direction in which the sheet is curled in the first curl forming part, said second curl forming part being provided downstream of a confluent part of said third conveyance path and said first conveyance path, wherein a curling amount of the sheet in said second curl forming part is set to be smaller than a curling amount of the sheet in said first curl forming part, and the curling amount of the sheet in said second curl forming part is variable according to rigidity of the sheet.

2. An image forming apparatus according to claim 1, wherein the first curl forming part curls the sheet in a direction opposite to a direction of a curl of the sheet formed according to a shape of a nip part in the fixing part.

3. An image forming apparatus according to claim 1, wherein the second curl forming part comprises a larger diameter roller and a plurality of smaller diameter rollers capable of being on the larger diameter roller with pressure or off the larger diameter roller; and the plurality of the smaller rollers is off from the larger diameter roller to vary the curling amount of the sheet in the second curl forming part according to the rigidity of the sheet.

4. An image forming apparatus according to claim 3, wherein the plurality of smaller diameter rollers are held by a roller holder; and a central portion of the roller holder is urged in a direction of the larger diameter roller so that the plurality of smaller diameter rollers is on or off the larger diameter roller.

5. An image forming apparatus according to claim 1, further comprising inputting means for inputting information on the rigidity of the sheet, wherein the curling amount of the sheet in said first curl forming part is variable based on the information on the rigidity of the sheet obtained from said inputting means.

* * * * *